US005551511A

United States Patent [19]

Holtby

[11] Patent Number: 5,551,511

[45] Date of Patent: Sep. 3, 1996

[54] DRILLING FLUID CONTAINMENT APPARATUS FOR USE IN DISCONNECTING A KELLY FROM A DRILL STRING

[76] Inventor: Quinn A. J. Holtby, 3611 - 111B Street, Edmonton, Alberta, Canada, T6J 1G9

[21] Appl. No.: 374,024

[22] Filed: Jan. 18, 1995

[30] Foreign Application Priority Data

Feb. 18, 1994 [CA] Canada ..... 2116520

[51] Int. Cl.[6] ..... E21B 33/00

[52] U.S. Cl. ..... 166/81.1

[58] Field of Search ..... 166/80–85

[56] References Cited

U.S. PATENT DOCUMENTS

| | | | |
|---|---|---|---|
| 319,693 | 1/1892 | Bond et al. . | |
| 2,096,882 | 10/1937 | Chernosky | 166/81 |
| 2,522,444 | 9/1950 | Grable | 166/81 |
| 2,610,690 | 9/1952 | Beatty | 166/81 |
| 2,716,455 | 8/1955 | Jones, Jr. | 166/81 |
| 3,738,436 | 6/1973 | Litchfield et al. | 175/65 |
| 4,450,905 | 5/1984 | Crain | 166/85 |

*Primary Examiner*—Michael Powell Buiz
*Attorney, Agent, or Firm*—Anthony R. Lambert

[57] ABSTRACT

A drilling fluid containment apparatus for use in disconnecting a kelly from a drill string is described, which includes an open ended tubular containment chute divided along its longitudinal axis into two pivotally connected halves. An annular attachment plate is used to attach the containment chute to the kelly. The drilling fluid containment apparatus, as described, can be physically attached to a saver sub disposed below the kelly where access by conventional mud savers is restricted by the kelly bushing.

1 Claim, 2 Drawing Sheets

DRILLING FLUID CONTAINMENT APPARATUS FOR USE IN DISCONNECTING A KELLY FROM A DRILL STRING

The present invention relates to a drilling fluid containment apparatus for use in disconnecting a kelly from a drill string.

BACKGROUND OF THE INVENTION

During drilling operations, drilling fluid is pumped down the drill string. The drilling fluid serves to carry cutting from the drill bit to the surface and creates a hydrostatic pressure that prevents a blowout condition from occurring. The drill string consists of a plurality of joined sections of pipe. As these joined sections of pipe are "tripped" out of the hole they must be disconnected. When they are disconnected drilling fluid tends to spray uncontrollably over men and equipment. U.S. Pat. No. 319,693 which issued in 1932 describes an apparatus which was developed to disconnect sections of drill string. This apparatus, which is still in use today, has come to be known as a "mud saver". It consists of cooperating semi-circular wall members which fit around a joint to form an enclosed chamber. In order to provide pressure containment the apparatus weighs approximately 500 pounds and is suspended in position by a hoist while two or more men swing it in and out of position. The pipe joint is disconnected while inside the enclosed chamber. The drilling fluid which is released is drained by a drainage member, usually in the form of a flexible hose. The use of this apparatus helps prevent the derrick floor from becoming slippery with drilling fluids. It also prevents the loss of drilling fluids which could otherwise be recirculated.

A kelly and its associated rotary hose contain approximately 20 gallons of drilling fluid. When the kelly is disconnected from the drill string that drill fluid exits under considerable pressure. The problems associate with the disconnection of the kelly are similar to the problems encountered when disconnecting the joints of drill pipe making up the drill string. However apparatus, such as described in U.S. Pat. No. 319,693, are unsuitable for use when disconnecting the kelly as the Kelly bushing is in the way.

Another approach that has been used to address the problem is to attach a valve directly to the Kelly, with the valve becoming part of the drill string. An example of such a valve is U.S. Pat. No. 3,738,436 which issued to Smith International Inc. in 1973. The reference discloses a valve which closes when drill pipe pressures decrease below preset levels. When the valve is in the closed position, drilling fluid is contained within the Kelly. The valves are in constant communication with abrasive drilling fluids. Maintenance is required on a weekly or bi-monthly basis to avoid valve failure.

SUMMARY OF THE INVENTION

What is required is a drilling fluid containment apparatus for use in disconnecting a kelly from a drill string that requires comparatively little maintenance.

According to the present invention there is provided a drilling fluid containment apparatus for use in disconnecting a kelly from a drill string which includes an open ended tubular containment chute divided along its longitudinal axis into two pivotally connected halves. Means is provided for physical attachment of the containment chute to the kelly.

The drilling fluid containment apparatus, as described, can fit below the kelly bushing. It does not have an enclosed chamber and for that reason can be made light weight as pressure containment is not of concern. When the apparatus is placed in position, drilling fluids exiting the kelly flow along the containment chute and out the open end. It is preferred that annular sealing means is provided at the end of the containment chute which is physically attached to the kelly assembly.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
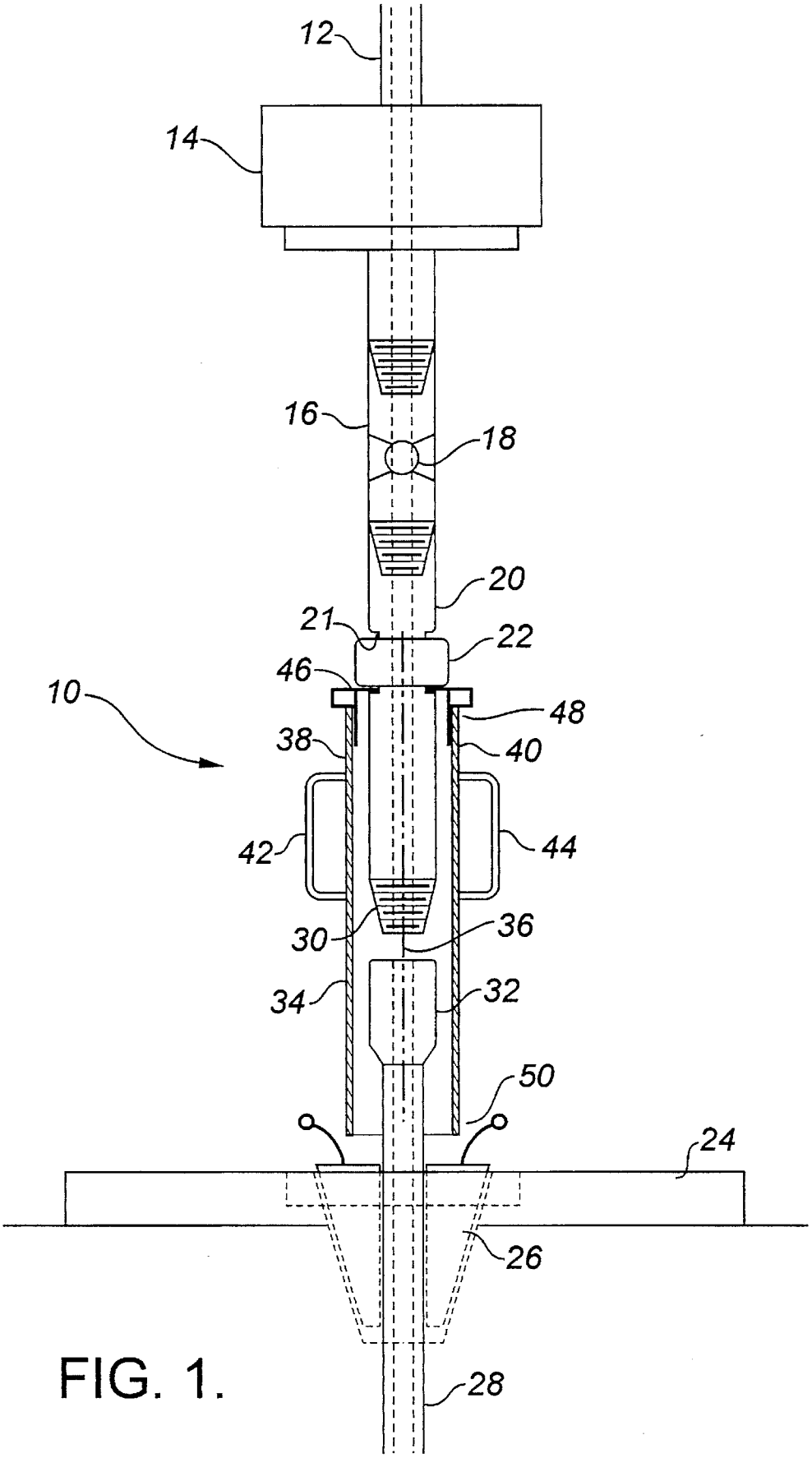
FIG. 1 is a side elevation view in longitudinal section of a drilling fluid containment apparatus constructed in accordance with the teachings of the present invention.

The preferred embodiment, a drilling fluid containment apparatus for use in disconnecting a kelly from a drill string generally identified by reference numeral 10, will now be described with reference to FIGS. 1 through 3.

Figure 2:
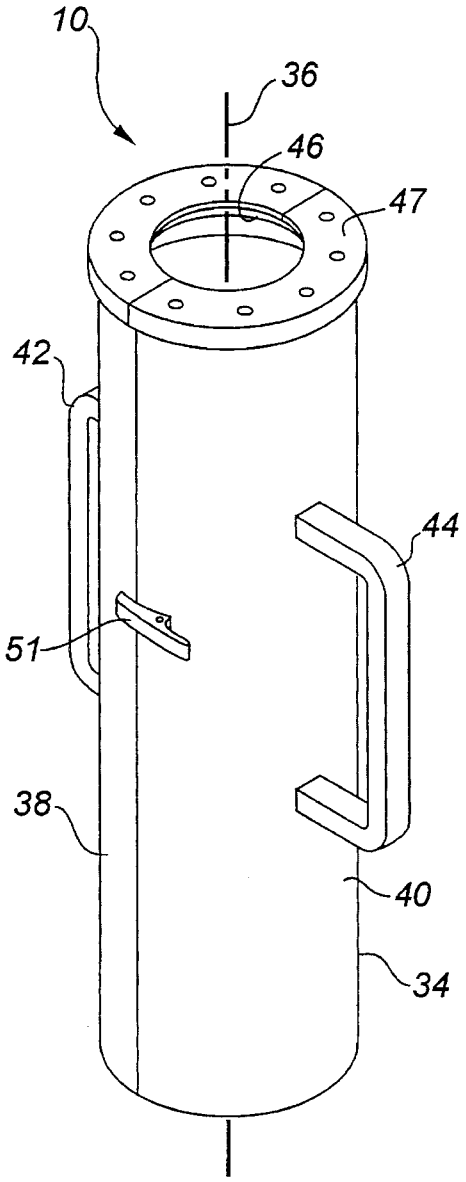
FIG. 2 is a perspective view of the drilling containment apparatus illustrated in FIG. 1 in a closed position.

Referring to FIG. 1, there is disclosed the environment in which drilling fluid containment apparatus 10 must be capable of functioning. The assembly of drilling components include a kelly 12, a kelly bushing 14, a lower kelly cock 16 with integral ball valve 18, a saver sub 20 with an annular groove 21 which accommodates associated rubber element 22, a rotary drilling table 24, slips 26 and a drill pipe 28. Drill pipe 28 is intended to represent the top section of a drill string. The drill string would, of course, consist of a plurality of interconnected sections of drill pipe 28. The form of connections are referred to as "box" and "pin" connections. Saver sub 20 has a pin connection 30. Drill pipe 28 has a box connection 32.

Figure 3:
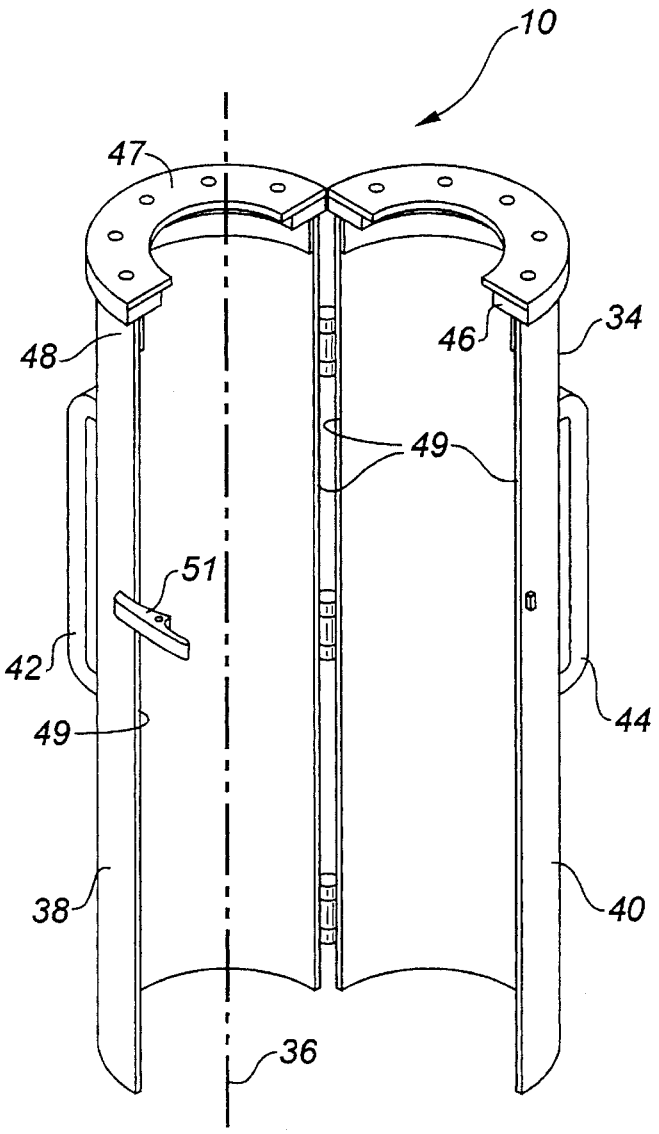
FIG. 3 is a perspective view of the drilling containment apparatus illustrated in FIG. 1 in an open position.

Referring to FIGS. 1 and 3, drilling fluid containment apparatus 10 includes an open ended tubular containment chute 34. Containment chute 34 is divided along its longitudinal axis 36 into two pivotally connected halves 38 and 40. Halves 38 and 40 can be pivoted into a closed position, as illustrated in FIG. 2, to form a closed tubular containment chute, or can be pivoted into an open position, as illustrated in FIG. 3, leaving room for insertion of a tubular member. Referring to FIGS. 1 and 2, in order to facilitate handling halves 38 and 40 have handles 42 and 44, respectively. Referring to FIGS. 1 and 3, an annular sealing flange 46 is provided at end 48 of containment chute 34. Disposed above annular sealing flange 46 is an annular engagement plate 47, which serves as a means for physically attaching drilling fluid containment apparatus 10 to saver sub 20, as will be hereinafter further described. Referring to FIG. 3, a longitudinal urethane sealing strip 49 is positioned where halves 38 and 40 mate to prevent drilling fluids from leaking between halves 38 and 40. It is important to note that opposed end 50 of containment chute 34 is open ended. Referring to FIG. 2, an optional quick release clamping mechanism 51 can be provided for securing halves 38 and 40 in a closed position.

The use and operation of drilling fluid containment apparatus 10 will now be described with reference to FIGS. 1 through 3. Drill pipe 28 is held in position by slips 26. Saver sub 20 is generally the drilling component associated with kelly 12 that is secured to the drill string, as represented by drill pipe 28. Halves 38 and 40 of containment chute 34 are pivoted into an open position enabling them to be positioned around saver sub 20. Halves 38 and 40 are then pivoted into the closed position forming tubular containment chute 34. The preferred positioning for drilling fluid containment apparatus 10 is immediately below rubber element 22 on saver sub 20. In this position, annular engagement plate 47 engages annular groove 21 of saver sub 20. Once annular engagement plate 47 is engaged in annular groove 21, the weight of drilling fluid containment apparatus 10 is supported by saver sub 20. Once annular engagement plate 47 engaged in annular groove 21, annular sealing flange 46 prevent drilling fluids from passing past end 48. The function of Sealing along the longitudinal mating of halves 38 and 40 is performed by longitudinal urethane sealing strips 49. Halves 38 and 40 are held in a closed position by means of quick release clamping mechanism 51 or held in place by means of handles 42 and 44, while pin connection 30 is removed from box connection 32. Upon the separation of pin connection 30 and box connection 32 drilling fluid enters containment chute 34. The flow of drilling fluids at end 48 of containment chute 34 is precluded by annular engagement plate 47 and annular sealing flange 46. The drilling fluids fall by force of gravity out open end 50.

Mud Saver apparatus, such as U.S. Pat. No. 319,693 had to be build to contain pressure. This resulted in such apparatus being in excess of 500 pounds and suspended on chains from the drilling rig. When not in use the mud saver apparatus was pushed to one side. This created a potentially dangerous situation as premature uncontrolled release of the mud saver apparatus would send a giant 500 pound pendulum sweeping above the drilling rig floor. In contrast, drilling fluid containment apparatus does not have to be pressure rated. It must merely serve to direct the flow of drilling fluids out open end 50. It can be made to weight under 50 pounds and once placed in position, as described, is supported by saver sub 20. In contrast with valves, as taught by U.S. Pat. No. 3,738,436, drilling fluid containment apparatus 10 is maintenance free.

It will be apparent to one skilled in the art that drilling fluid containment apparatus 10 addressed a problem long felt in the industry, as it can fit below the kelly where access by conventional mud savers is restricted by the kelly bushing. It will also be apparent to one skilled in the art that the described drilling fluid containment apparatus could, if desired, be used in tripping operations. It will finally be apparent to one skilled in the art that modifications may be made to the illustrated embodiment without departing from the spirit and scope of the invention as defined by the Claims.

The embodiments of the invention in which an exclusive property or privilege is claimed are as follows:

1. In combination:

a kelly assembly including: a kelly, a kelly bushing and a tubular member disposed below the kelly bushing having an annular groove;

a drilling fluid containment apparatus, comprising:

a. a tubular containment chute divided along its longitudinal axis into two pivotally connected halves, each of the halves having an attached handle by means of which the two pivotally connected halves are manipulated into position and pivoted between a spaced apart open position and a closed position encircling the tubular member; and b. an annular engagement plate split between the two pivotally connected halves at one end of the containment chute, the annular engagement plate engaging the annular groove of the tubular member when the two pivotally connected halves are in the closed position thereby physically attaching the containment chute to the tubular member of the kelly assembly; and c. annular sealing means at the one end of the containment chute immediately adjacent to the annular engagement plate, the annular sealing means engaging the tubular member when the two pivotally connected halves are in the closed position, and when the two pivotally connected halves are in the closed position the sole means of egress for drilling fluids being an open ended opposed end of the tubular containment chute.

* * * * *